US006533670B1

(12) United States Patent
Drobnis

(10) Patent No.: US 6,533,670 B1
(45) Date of Patent: Mar. 18, 2003

(54) AMUSEMENT RIDE WITH PIVOTABLE MOTION BASE

(75) Inventor: Nicholas H Drobnis, West Hills, CA (US)

(73) Assignee: Universal City Studio, Inc., Universal City, CA (US)

( * ) Notice: Subject to any disclaimer, the term of this patent is extended or adjusted under 35 U.S.C. 154(b) by 0 days.

(21) Appl. No.: 09/638,644

(22) Filed: Aug. 14, 2000

(51) Int. Cl.[7] ..... A63G 31/16

(52) U.S. Cl. ..... 472/60; 472/61; 472/130; 434/55

(58) Field of Search ..... 472/59, 60, 61, 472/130, 136, 137; 434/29, 55, 58

(56) References Cited

U.S. PATENT DOCUMENTS

| | | | | | |
|---|---|---|---|---|---|
| 3,602,499 | A | | 8/1971 | Kojima | |
| 3,619,911 | A | * | 11/1971 | Pancoe | 434/55 |
| 3,967,387 | A | * | 7/1976 | Marchegiani | 434/55 |
| 4,753,596 | A | * | 6/1988 | Hart et al. | 434/29 |
| 5,429,562 | A | * | 7/1995 | Milner | 482/51 |
| 5,433,608 | A | * | 7/1995 | Murray | 434/29 |
| 5,507,647 | A | * | 4/1996 | Morris | 434/55 |
| 5,513,990 | A | * | 5/1996 | Gluck | 434/58 |
| 5,597,359 | A | * | 1/1997 | Byerly | 472/60 |
| 5,759,107 | A | | 6/1998 | Nagel | |
| 5,772,513 | A | | 6/1998 | Ohishi | |
| 5,791,903 | A | | 8/1998 | Feuer | |
| 5,931,739 | A | * | 8/1999 | Layer et al. | 472/60 |
| 6,042,382 | A | * | 3/2000 | Halfhill | 434/59 |
| 6,059,926 | A | * | 8/2000 | Hettema et al. | 472/59 |

* cited by examiner

*Primary Examiner*—Kien T. Nguyen
(74) *Attorney, Agent, or Firm*—Perkins Coie LLP

(57) ABSTRACT

An amusement ride includes a motion base having multiple degrees of freedom. An audience platform is eccentrically pivotable on top of the motion base about a pivot point that is eccentrically offset from a central region of the audience platform. A motor disposed on either the motion base or the audience platform is used to pivot the audience platform via a shaft. A projection screen is located either on board or off board and is used to display images or a motion picture. The amusement ride simulates fishtailing, slide out, and similar movements experienced as a vehicle turns.

21 Claims, 4 Drawing Sheets

AMUSEMENT RIDE WITH PIVOTABLE MOTION BASE

BACKGROUND OF THE INVENTION

The field of the invention is theme or amusement park ride attractions. More specifically, the invention relates ride attractions using motion bases having one or more degrees of freedom.

Theme or amusement park ride attractions have become increasingly popular. Amusement rides can generally be characterized into rides that include ride vehicles that travel along a track and rides that are fixed relative to the ground. In fixed rides, a passenger platform or ride vehicle is typically situated on a motion base having multiple degrees of freedom. See U.S. Pat. No. 5,192,247, incorporated by reference. These types of motion bases are also frequently positioned adjacent one or more projection screens. A series of images or a motion picture is then projected onto the screen. For added realism and effect, the movement of the motion base can be synchronized with the projected images.

The motion base can move the passenger platform or ride vehicle in several different directions including angular movements, such as roll, pitch and yaw, and linear movements, such as heave and surge. These various degrees of freedom can be used to simulate the effect of actually moving in synchronization with the projected images or motion picture.

For example, in an amusement ride that attempts to simulate the feeling of racing through city streets in an automobile, the motion base might use a combination of roll and yaw to give passengers the feeling of moving around sharp turns while the image on the screen shows a view of rounding a curve in the street. In conventional motion bases, however, yaw motion is imparted to a passenger platform or ride vehicle via a central pivot point. Consequently, the ride vehicle spins or rotates about a generally central location. Unfortunately, this motion does not realistically correspond to the movement experienced when moving around a sharp turn in a vehicle. Rather, a real vehicle turning a sharp corner tends to "fishtail," with the back end of the vehicle tending to rotate about the front of the vehicle. A certain degree of realism is thus lost in conventional ride attractions.

Accordingly, there is a need for an improved amusement ride that more realistically simulates turning movement of a vehicle. It is an object of the invention to provide a motion base with multiple degrees of freedom, including eccentrically offset yaw-type motion that resembles fishtail movement.

SUMMARY OF THE INVENTION

In a first aspect of the invention, an amusement ride includes a motion base having multiple degrees of freedom, a projection screen adjacent to the motion base, and an audience platform eccentrically pivotable on the motion base. The audience platform is pivotable about a pivot point eccentrically offset from a central region of the audience platform. A motor drives the audience platform in a pivoting movement about the pivot point.

In a second aspect of the invention, the motor is located either on the audience platform or on the motion base.

In a third aspect of the invention, a method of producing fishtail type movement on a motion base includes the steps of moving a motion base in more than one degree of freedom, projecting moving images on a screen adjacent to the motion base, and pivoting an audience platform on top of the motion base, about a pivot point that is eccentrically offset from a central region of the audience platform.

In a fourth aspect of the invention, an amusement ride includes a ride vehicle that is fixed to the audience platform. The ride vehicle is pivotable with the audience platform via a motor on the motion base. An on board projection moves with the ride vehicle.

In a fifth aspect of the invention, the amusement ride of the fourth aspect has the motor disposed on the audience platform rather than on the motion base.

The invention resides as well in subcombinations of the elements and steps described.

BRIEF DESCRIPTION OF THE DRAWINGS

FIG. 1 (*b*) is a top view of the amusement ride of FIG. 1 (*a*).

FIG. 2(*b*) is a top view of the amusement ride of FIG. 2(*a*).

FIG. 3(*b*) is a top plan view of the amusement ride of FIG. 3(*a*).

DETAILED DESCRIPTION OF THE PREFERRED EMBODIMENTS

Figure 1A:
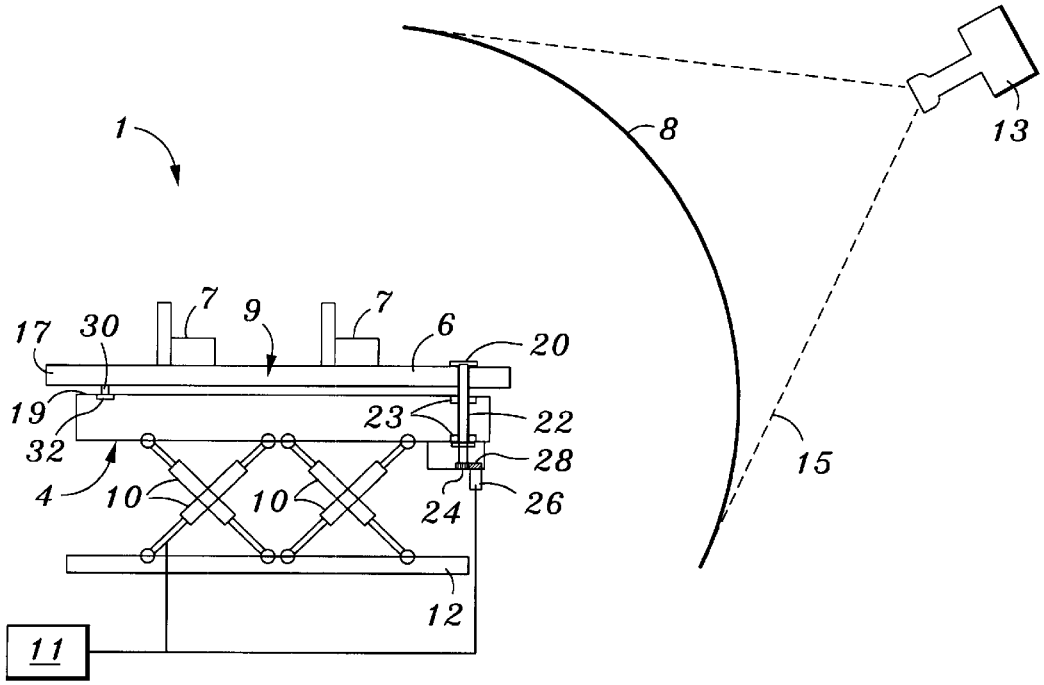
FIG. 1(*a*) is a side view of the amusement ride of the inventions showing the motion base, the passenger platform, and projection screen, with the motor on the motion base.
Figure 1B:
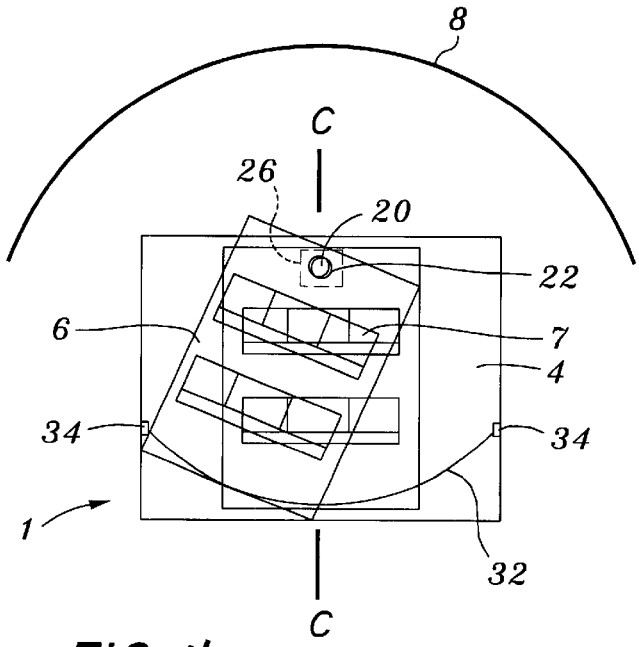

FIGS. 1(*a*) and 1(*b*) illustrate an amusement ride 1 including a motion base 4 and an audience platform 6 on top of the motion base 4. The audience platform 6 is eccentrically pivotable on the motion base 4. The audience platform 6 pivots about pivot point 20 that is eccentrically offset from a central region 9 of the audience platform 6. When the audience platform 6 pivots about pivot point 20, fishtail-type sliding out, or turning movement is simulated.

A plurality of actuators 10 connect the motion base 4 to the floor 12 or other supporting structure. The actuators 10 are preferably controllable via a controller or computer 11 to impart motion in multiple degrees of freedom on the motion base 4 and audience platform 6. The actuators 10 my be linear electrical actuators or hydraulic cylinders as shown, for example, in FIGS. 1(*a*) and 1(*b*), or alternatively, the actuators 10 can be pneumatically or mechanically driven.

Still referring to FIGS. 1(*a*) and 1(*b*), a projection screen 8 is preferably located adjacent to the motion base 4 and audience platform 6. Images or a motion picture 15 are displayed on the projection screen 8. The images on the projection screen 8 can be projected from a projector 13 located either behind or in front of the projection screen 8. The projection screen 8 can also be a monitor, liquid crystal display, active matrix display, flat panel display, plasma display, or the like. The projection screen 8 can be flat or curved. The projection screen 8 may also completely surround or envelop the amusement ride 1. The audience platform 6 facing the screen 8 preferably includes a plurality of seats 7. FIGS. 1(*a*), 1(*b*), 2(*a*), and 2(*b*) illustrate a curved projection screen 8 generally positioned in front of the motion base 4 and audience platform 6. Preferably, the movement of the motion base 4 and audience platform 6 is synchronized with the displayed images 15 on the projection screen 8, via the controller 11. The projector 13 may also project 3D images, using separate left and right eye projection systems.

Referring back to FIG. 1(*a*), a shaft 22 is located in the motion base 4 and audience platform 6 at the pivot point 20. The shaft 22 is rotatable within the motion base 4 via bearings 23. The shaft 22 is also fixed to the audience platform 6. The audience platform 6 rotates with the shaft 22.

The shaft 22 preferably projects through the bottom of the motion base 4 and terminates in a gear or sprocket 24. A motor 26 is secured to the motion base 4 adjacent to the shaft 22. The motor 26 is mechanically coupled to a gear or sprocket 24 on the shaft 22 by a gear or other linkage 28 that translates rotational movement of the gear 28, as driven by the motor 26, to rotational or pivoting movement of the shaft 22. Of course, other equivalent mechanical linkages, such as chains, belts, bar linkages, etc., may also be used.

The motor 26 may include devices such as a rotary actuator, servo, or the like. The motor 26 may be electrically, pneumatically or hydraulically driven. The motor 26 is preferably connected to the controller 11 used to control the motion base 4. In this way the movement of the audience platform 6 and motion base 4 can be synchronized with images 15 on the projection screen 8.

An arc roller 30 is preferably located on the underside of the audience platform 6, near the back end 17 of the audience platform 6. The arc roller 30 provides a low friction rolling contact between the audience platform 6 and the motion base 4. An optional track 32 may be positioned on the upper surface of the motion base 4. When the track 32 is used, the arc roller 30 is positioned on the audience platform 6 so that it rolls within or on the track 32. If a track 32 is not used, the arc roller 30 contacts the upper surface 19 of the motion base 4.

FIG. 1(*b*) illustrates the audience platform 6 pivoting about the pivot point 20. The audience platform 6 pivots or sweeps through an arc on top of the motion base 4 as driven by the motor 26. Preferably, the motion base 4 includes a pair of motion stops 34 on either side of the motion base 4. The motion stops 34 act as an additional safety mechanism to prevent the audience platform 6 from pivoting too far.

Figure 2A:
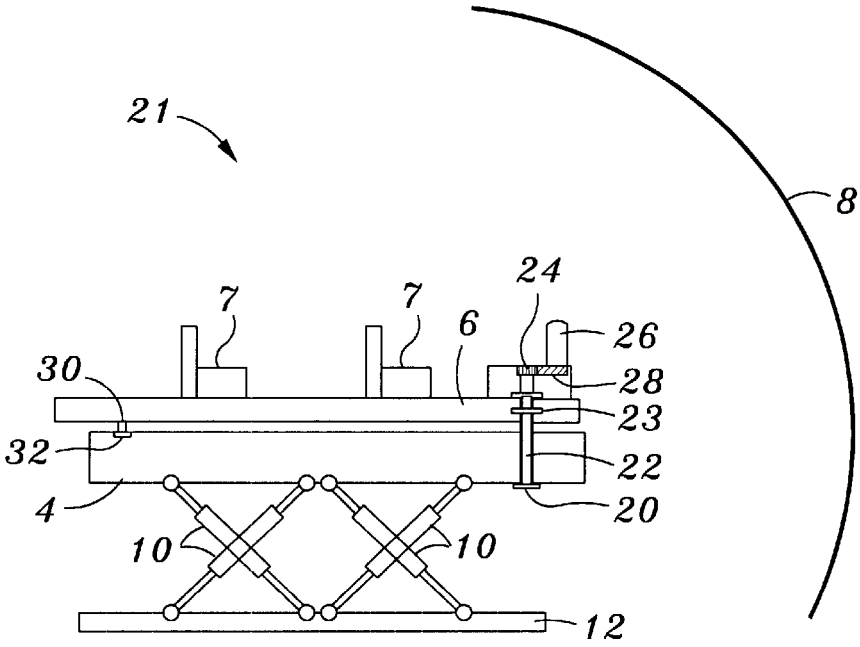
FIG. 2(*a*) is a side view of a second embodiment having the motion base, the passenger platform, and projection screen, and with the motor on the audience platform.
Figure 2B:
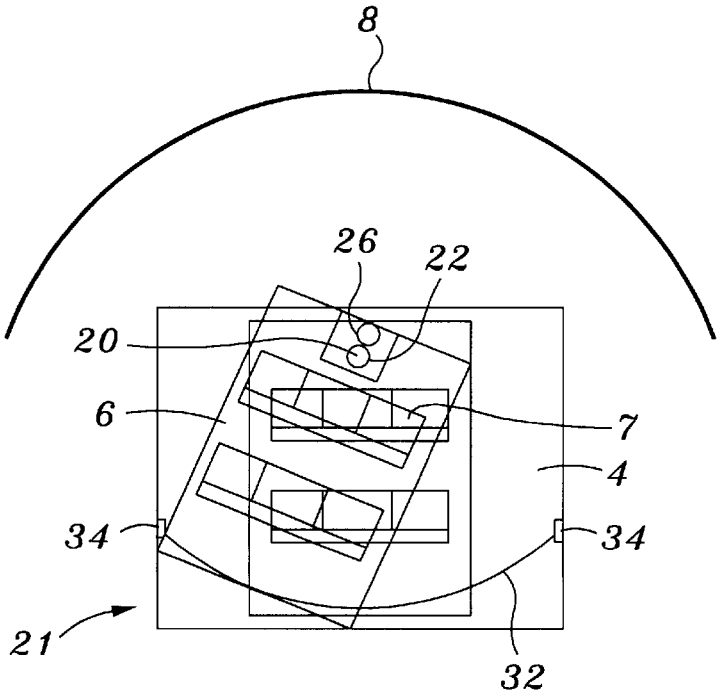

Referring now to FIGS. 2(*a*) and 2(*b*), in an alternative embodiment 21, the motor 26 is fixed to the audience platform 6. The shaft 22 is rotatable within the audience platform 6 via bearing 23. The shaft 22 is fixed to the motion base 4. When the motor 26 is energized, the motor 26 engages with the shaft 22 in a similar manner as described in the previous embodiment. This causes the audience platform 6 to pivot about pivot point 20. The other elements of the embodiment 21 are the same as described above.

Figure 3A:
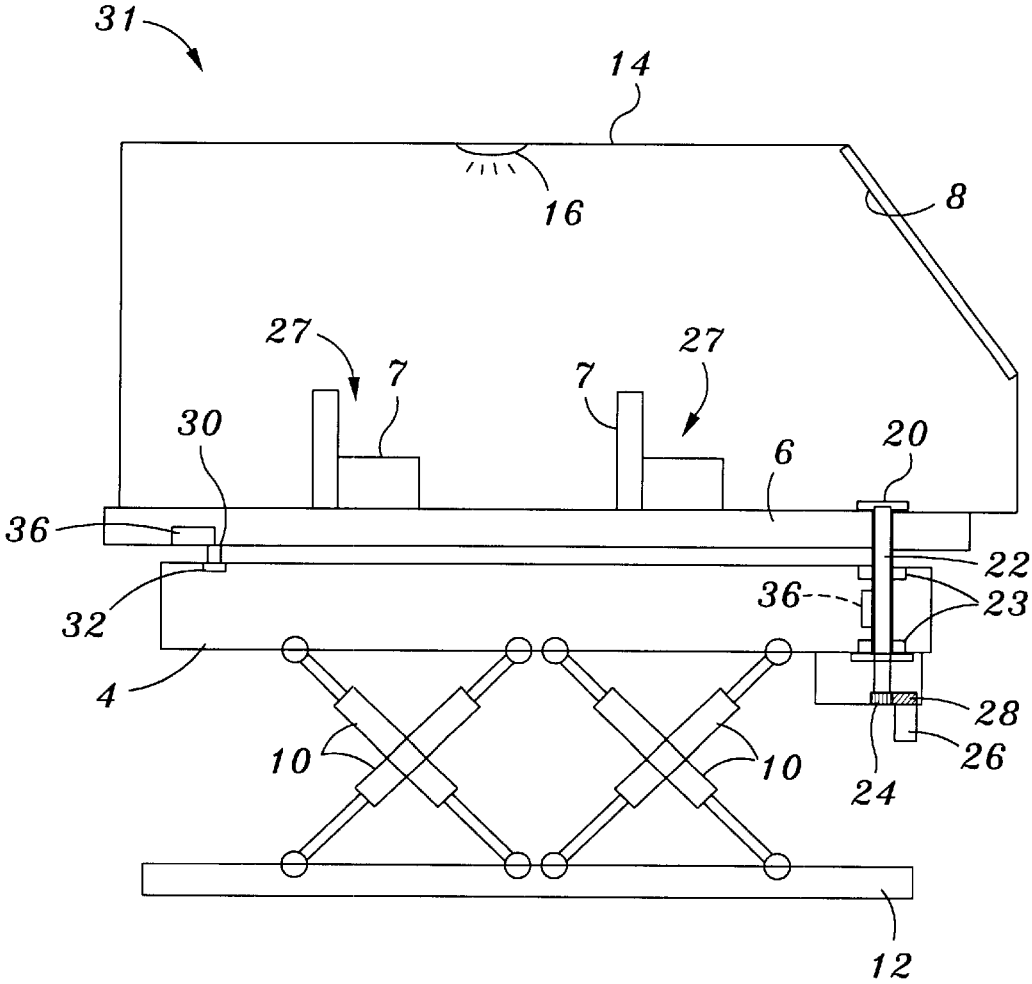
FIG. 3(*a*) is a side of another embodiment having the motion base, the passenger platform, and projection screen, with ride vehicle mounted on the passenger platform.
Figure 3B:
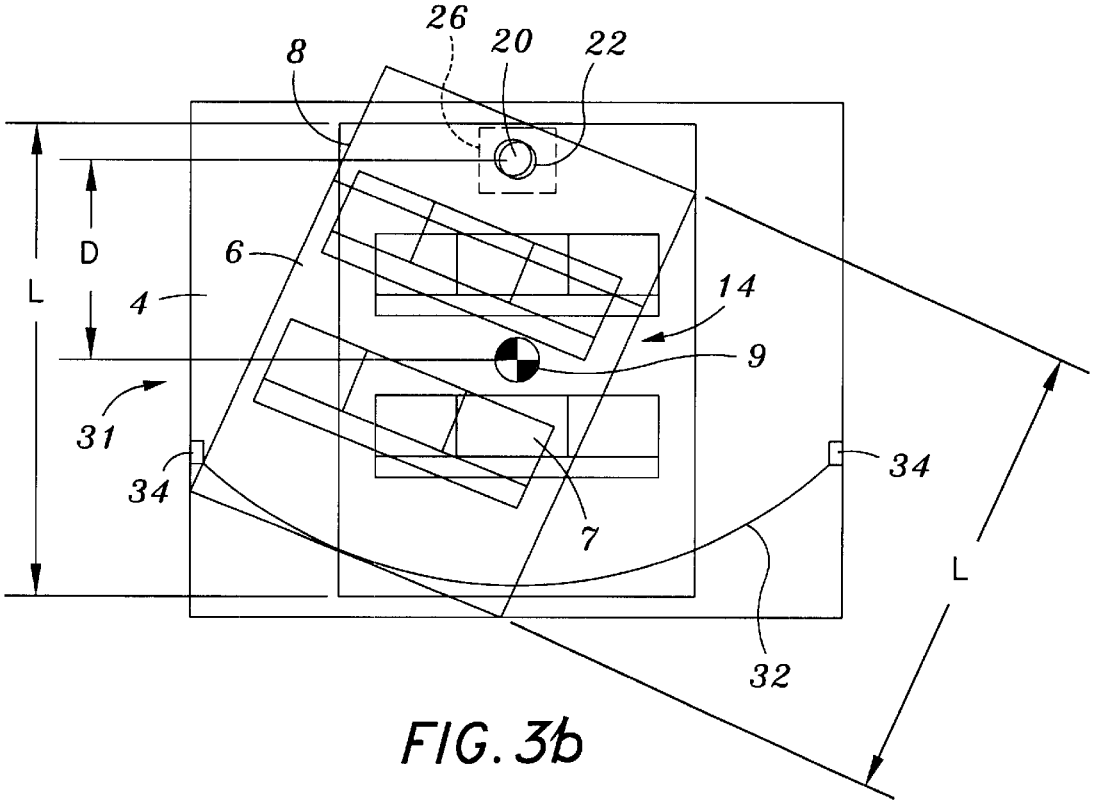

FIGS. 3(*a*) & 3(*b*) illustrate yet another embodiment 31 having a ride vehicle 14 positioned on top of the audience platform 6. The ride vehicle 14 can take any number of shapes and appearances, such as an automobile, spacecraft, boat, etc. A projection screen 8 is preferably located within the ride vehicle 14. In this manner, the projection screen 8 is considered to be "on board." The ride vehicle 14 may also include one or more speakers 16 that emit sound effects and/or music in synchronization with the projected images 15 on the projection screen 8.

The ride vehicle 14 may also be included on the audience platform 6 with the projection screen 8 located "off board", i.e., external to the ride vehicle 14, for example, if the ride vehicle 14 has an open top or a window in which the passengers view the projected images.

During operation of the ride, passengers load onto the passenger platform 6 or ride vehicle 14, if used. The motion base 4 can lower itself to a lowered position where passengers can step onto the passenger platform 6 or the ride vehicle 14. Stairs or a bridge-type loading structure can also be used to load passengers into the ride. Alternatively, the floor 12 can be a drop-down floor used to load passengers into the ride.

Passengers typically are then seated in seats 7 and appropriate restraints such as belts, lap bars, and the like are used to keep the passengers safely secured to the passenger platform 6 or ride vehicle 14. Alternatively, passengers may stand on the audience platform 6 or ride vehicle 14 throughout the amusement ride. Once the ride has been loaded with passengers, a series of images or a motion picture is projected onto the projection screen 8. During this time, the motion base 4 begins to move the audience platform 6. Preferably, the movement of the motion base 4 is synchronized with the images or motion picture on the projection screen 8.

At one or more points during the ride 31, the motor 26 is activated to pivot the audience platform 6. By pivoting the audience platform 6, the passengers experience fishtail, sliding, or turning movement (preferably synchronized with the images or motion picture projection on the projection screen 8). The fishtail motion produced by the eccentrically pivotable audience platform 6 can be used in various themes or environments. For example, the ride 31 can be used to simulate riding in a car, boat, motorcycle, spacecraft, and the like. The ride 31 can also be used to simulate additional activities such as skateboarding, snow skiing, snowboarding, surfing, waveboarding, mountainboarding, water skiing, etc.

After the ride is over, the motion base 4 returns to the initial loading position. At this point the passengers are released from any restraining device(s) and disembark the audience platform 6. A new group of passengers cane then load onto the audience platform 6 or ride vehicle 14.

In an alternate design and method, the audience platform 6 may also pivot via gravity, by having the motion base 4 roll left or right. The motor 26 and drive linkage 24 and 28 can then be omitted, or not used. Brakes 36 may be provided at the rollers 30, or on the shaft 22 to better control the movement of the platform 6, whether via gravity or via the motor 26. The brakes 36, if used, may also be connected to the controller 11, to provide coordinated movement via the brakes 36, the motor 26, and/or the motion base 4.

The screen 8 may equivalently be replaced by an individual display provided at each passenger position 27 on the platform 6, or the screen 8 may be in the form of a helmet/visor display, or virtual reality display, worn by, or supported by or in front of, one or more passengers.

While embodiments of the present invention have been shown and described, various modifications may be made without departing from the scope of the present invention. The invention, therefore, should not be limited, except to the following claims, and their equivalents.

What is claimed is:

1. An amusement ride comprising:

a motion base;

a projection screen adjacent to the motion base;

an audience platform pivotable about a pivot point offset from a central region of the audience platform; and a motor mechanically coupled to the audience platform via a rotatable shaft at the pivot point.

2. The amusement ride according to claim 1 further including a roller on an underside of the audience platform.

3. The amusement ride according to claim 2, with the motion base including a track for engagement with the roller.

4. The amusement ride according to claim 1, further including a pair of spaced apart motion stops on the motion base.

5. The amusement ride according to claim 1, further including means for moving the motion base and the audience platform in synchronization with images projected on the projection screen.

6. An amusement ride comprising:

a motion base having multiple degrees of freedom;

a projection screen adjacent to the motion base;

an audience platform on top of the motion base and pivotable about a pivot point that is offset from a central region of the audience platform; and a motor mechanically coupled to the motion base via a rotatable shaft disposed at the pivot point.

7. The amusement ride according to claim 6, further including a roller on an underside of the audience platform for engaging an upper surface of the motion base.

8. The amusement ride according to claim 6, further including a brake for braking the movement of the audience platform.

9. The amusement ride according to claim 6, including a plurality of seats on the audience platform and facing the front end of the platform and with the pivot point adjacent the front end of the platform.

10. The amusement ride according to claim 6, with the motion base including means for providing roll movement of the audience platform, with the roll movement causing the audience platform to pivot about the pivot point, via gravity.

11. The amusement ride according to claim 6, wherein the motion base and the audience platform move in synchronization with images projected on the projection screen.

12. An amusement ride comprising:

a motion base having multiple degrees of freedom;

an audience platform supported by the motion base and pivotable about a pivot point eccentrically offset from a central region of the audience platform;

a motor mechanically coupled to the audience platform via a rotatable shaft disposed at the pivot point;

a ride vehicle on the audience platform; and a projection screen on board the ride vehicle.

13. An amusement ride comprising:

a motion base;

a projection screen adjacent to the motion base;

an audience platform pivotable about a pivot point offset from a center of the audience platform; and a pair of spaced apart motion stops on the motion base.

14. An amusement ride comprising:

a motion base;

a projection screen adjacent to the motion base; an audience platform pivotable about a pivot point offset from a center of the audience platform; and a motor mechanically coupled to the motion base via a rotatable shaft at the pivot point.

15. An amusement ride comprising:

a motion base having multiple degrees of freedom;

a projection screen adjacent to the motion base;

an audience platform on top of the motion base and pivotable about a pivot point that is offset from a central region of the audience platform; and a motor mechanically coupled to the audience platform via a rotatable shaft disposed at the pivot point.

16. The amusement ride according to claim 15, further including a roller on an underside of the audience platform for engaging an upper surface of the motion base.

17. The amusement ride according to claim 15, further including a brake for braking the movement of the audience platform.

18. The amusement ride according to claim 15, including a plurality of seats on the audience platform and facing the front end of the platform and with the pivot point adjacent the front end of the platform.

19. The amusement ride according to claim 15, with the motion base including means for providing roll movement of the audience platform, with the roll movement causing the audience platform to pivot about the pivot point, via gravity.

20. The amusement ride according to claim 15, wherein the motion base and the audience platform move in synchronization with images projected on the projection screen.

21. An amusement ride comprising:

a motion base having multiple degrees of freedom;

an audience platform supported by the motion base and pivotable about a pivot point eccentrically offset from a central region of the audience platform;

a motor mechanically coupled to the motion base via a rotatable shaft disposed at the pivot point;

a ride vehicle on the audience platform; and a projection screen on board the ride vehicle.

* * * * *